US010934932B2

(12) United States Patent
Dominiak et al.

(10) Patent No.: US 10,934,932 B2
(45) Date of Patent: Mar. 2, 2021

(54) INTERNAL COMBUSTION CLEANING

(71) Applicant: INNIO Jenbacher GmbH & Co OG, Jenbach (AT)

(72) Inventors: Krzysztof Andrzej Dominiak, Warsaw (PL); Patrick Hotter, Jenbach (AT); Michal Lukasz Sekrecki, Lodz (PL); Rebecca Weidl, Baden-Wuerttemberg (DE)

(73) Assignee: INNIO Jenbacher GmbH & Co OG, Jenbach (AT)

( * ) Notice: Subject to any disclaimer, the term of this patent is extended or adjusted under 35 U.S.C. 154(b) by 0 days.

(21) Appl. No.: 16/193,569

(22) Filed: Nov. 16, 2018

(65) Prior Publication Data

US 2019/0162115 A1 May 30, 2019

(30) Foreign Application Priority Data

Nov. 30, 2017 (EP) ..... 17461635

(51) Int. Cl.
*F02B 77/04* (2006.01)
*B08B 1/00* (2006.01)

(52) U.S. Cl.
CPC ..... *F02B 77/04* (2013.01); *B08B 1/005* (2013.01)

(58) Field of Classification Search
CPC ..... F02B 77/04; B08B 1/005
IPC ..... B08B 1/00
See application file for complete search history.

(56) References Cited

U.S. PATENT DOCUMENTS 845,917 A 7/1906 Thomas
1,332,606 A 3/1920 Chuck
1,510,157 A * 9/1924 Pemberton ..... F02B 77/04 15/104.011
8,557,003 B2 10/2013 Malfer et al.
2011/0010985 A1 1/2011 Hou
2011/0203546 A1 8/2011 Blythe et al.

FOREIGN PATENT DOCUMENTS

GB 11054 9/1909
GB 06233 2/1913

OTHER PUBLICATIONS

EP Search Report and Written Opinion dated Jul. 27, 2018 which was issued in connection with EP patent application No. 17461635.9 which was filed on Nov. 30, 2017.

* cited by examiner

*Primary Examiner* — David Redding
(74) *Attorney, Agent, or Firm* — Fletcher Yoder, P.C.

(57) ABSTRACT

A scraping tool for cleaning a combustion chamber of an internal combustion engine is provided. The scraping tool includes at least one scraper unit, a longitudinal carrier, and an activation device. The at least one scraper unit is configured to clean at least one surface of a cavity. The longitudinal carrier, preferably a rod or a tube, connects the at least one scraper unit with the activation device. The at least one scraper unit is swivel mounted on the longitudinal carrier and can be swiveled from a first position for introducing the at least one scraper unit into the cavity to a second position for cleaning at least one surface of the cavity. In the first position, the at least one scraper unit is disposed substantially parallel to the longitudinal carrier. In the second position, the at least one scraper unit is disposed at an angle between 70° and 110°, preferably between 80° and 100°, and more preferably at substantially 90°, with respect to the longitudinal carrier.

22 Claims, 2 Drawing Sheets

INTERNAL COMBUSTION CLEANING

BACKGROUND OF THE INVENTION

This invention relates to a scraping tool for cleaning a combustion chamber of an internal combustion engine with the features of the preamble of claim 1 and a method for cleaning a combustion chamber of an internal combustion engine.

BRIEF DESCRIPTION OF THE INVENTION

One of the most extended servicing challenges that appear in industrial reciprocating engine applications is the gradual buildup of carbon deposits on the walls of the combustion chamber. The carbon deposits originate mainly from the incomplete combustion of the fuel, which are primarily driven by a combination of insufficient mixing of the fuel and oxidants and the impurities present in the fuel. Impurities in the fuel can originate from a lack of fuel refinement, a contamination during transport, or both. Thus, the products of combustion tend to include different types of carbon particles, which are notoriously harmful due to the ease with which they adhere to surfaces and the difficulty to remove them.

The buildup of these deposits has a downstream effect in the engine performance by bringing an unwanted increase in the compression ratio, the appearance of hot spots—which often lead to engine knocking—and the subsequent increase in pollutant emissions.

For this reason, and due to the access difficulty of the components in the combustion chamber, there has been an interest in the industry to come up with solutions to prevent and remove these deposits without the need of dismantling the cylinder head. Some have taken the shape of fuel additives, like those presented by U.S. Pat. No. 8,557,003, which proactively help to mitigate the amount of carbon deposits in the combustion chamber by adding a solution with high detergency properties. Other fuel additives, like the ones presented by US 2011/0010985, rely on a modified fuel composition that contains an effective amount of deposit-modifying hydrocarbyl-substituted succinimide, a detergent and a fuel. The introduction of fuel additives, however, is less than ideal in the industrial environment, where the cost of the fuel has a major impact on the cost of products.

There are also several solutions that have been proposed that target a passive approach, i.e. the focus on the removal of the deposits once they have been created. Inventions like the welded scraper presented by US 2011203546 and U.S. Pat. No. 845,917 disclose a static scraper tool, which sits directly beneath the cylinder head and targets the deposits that build up on the outer crown of the piston as it reaches the top dead center (TDC). Although the system seems effective for the outer piston, it doesn't target the deposits on the cylinder head, cylinder liner nor the central part of the piston crown.

Despite the difficulties associated with the dismantling of the cylinder head, the cleanup of the combustion chamber is still an activity that is performed periodically in order to maintain the good working order of the engine.

For this, the cylinder head has to be dismantled with all of its attachments. In a next step the combustion chamber has to be cleaned by hand with the help of scraper tools, grinding tools or wire brushes to remove preferably all deposits on the walls of the combustion chamber or the top of the piston and on the cylinder head. When the combustion chamber and the cylinder head have been cleaned, they can be mounted again. This cleaning takes a lot of time, especially if the internal combustion engine has a higher number of combustion chambers.

It is the object of the invention to provide an easier and/or faster way to clean such a combustion chamber, wherein it is possible to reduce the costs for maintenance work.

This object is being accomplished by a scraping tool having the features of claim 1 and a method for cleaning a combustion chamber of an internal combustion engine. Advantageous embodiments of the invention are defined in the dependent claims.

This object is accomplished according to the invention by a scraping tool comprising at least one scraper unit, a longitudinal carrier and an activation device, wherein the at least one scraper unit is configured to clean at least one surface of a cavity and wherein the longitudinal carrier, preferably a rod or a tube, connects the at least one scraper unit with the activation device, wherein the at least one scraper unit is swivel mounted on the longitudinal carrier and that the at least one scraper unit can be swiveled from a first position for introducing the at least one scraper unit into the cavity to a second position for cleaning at least one surface of the cavity, wherein in the first position the at least one scraper unit is disposed substantially parallel to the longitudinal carrier and wherein in the second position the at least one scraper unit is disposed at an angle between 10° and 170°, preferably between 70° and 110° and more preferably at substantially 90°, with respect to the longitudinal carrier.

With the help of such a scraping tool according to the invention a cavity (as for example by a combustion chamber), which is only accessible by a small opening, can be cleaned without very time-consuming dismantling of attachment parts in order to allow a good accessibility. With the help of a scraping tool according to the invention, the at least one scraping unit can be introduced in a first position, can be swiveled into a second position and can clean the cavity in this second position.

It can be provided that the activation device comprises a handle, wherein a motion of the at least one scraper unit can be driven by hand. But it can also be provided that the activation device comprises a connection interface for a rotary drive, wherein a motion of the at least one scraper unit can be driven by the rotary drive.

Preferably it is provided that the scraping tool is configured for a rotational motion and/or longitudinal motion for scraping.

It can desirably be provided that the at least one scraper unit has a scraping surface and/or a grinding surface and/or that the at least one scraper unit comprises a wire brush. It can also be provided that the at least one scraper unit is replaceable. For that it can be provided that the cavity is cleaned in a first step by a scraping surface, removing coarse deposits, in a second step the scraper unit can be replaced by a scraper unit comprising a wire brush or a grinding surface for removing fine deposits.

It can further be preferably provided that a wire is connected to the at least one scraper unit leading through or on the longitudinal carrier to the activating device, wherein the wire is configured to move the at least one scraper unit between the first and the second position. Of course also other devices can be used to move the scraper unit from the first position to the second position, e.g. mechanical linkages or electric, hydraulic as well as pneumatic drives.

In a preferred embodiment of the invention a bore can provided inside the scraper tool to remove a combustion residue from the cavity. It can be provided that a conduct is provided, connected this bore, which can be used to remove the combustion residue from the cavity, with a suction apparatus. With the help of such a preferred embodiment of the invention, an easy and fast possibility is provided to remove the combustion residue from the cavity.

In an embodiment of the invention a stop is provided, fixed on the longitudinal carrier to determine the position of the at least one scraper unit inside the cavity. Such a stop ensures that only deposits are removed from the cavity and that the surfaces of the cavity do not be affected by the scraper unit.

A method according to the invention for cleaning a combustion chamber of an internal combustion engine comprises one of the following steps:

- remove a centrally mounted element, preferably a pre-chamber and a spark plug sleeve or an spark plug, from the cylinder head of the combustion chamber to open a through bore leading to the combustion chamber through the cylinder head
- introduce the at least one scraper unit of a scraping tool through the bore of the cylinder head into the combustion chamber, whereby the at least one scraper unit is in a first position
- move the scraper unit into a second position
- bring the at least one scraper unit in connection with the surface, which has to be cleaned
- clean the surface, which has to be cleaned, by setting the at least one scraper unit in motion.

It can be provided that with the help of the at least one scraper unit a cylinder head inside the combustion chamber and/or a wall of the combustion chamber and/or a upper surface of the piston can be cleaned.

It can also be provided that after cleaning a piston is moved away from the cylinder head before a combustion residue, produced by the cleaning process, is removed. This moving away of the cylinder from the cylinder head minimize the risk any debris remaining trapped between the piston ring and the cylinder wall.

The invention can be used in connection with all internal combustion engines with 6, 8, 10, 12, 20 or 24 combustion chambers, especially in connection with stationary reciprocating internal combustion engines.

BRIEF DESCRIPTION OF THE DRAWINGS

Further advantages and details will be apparent from the drawing and the specific description relating thereto. In the drawing.

DETAILED DESCRIPTION

Figure 1:
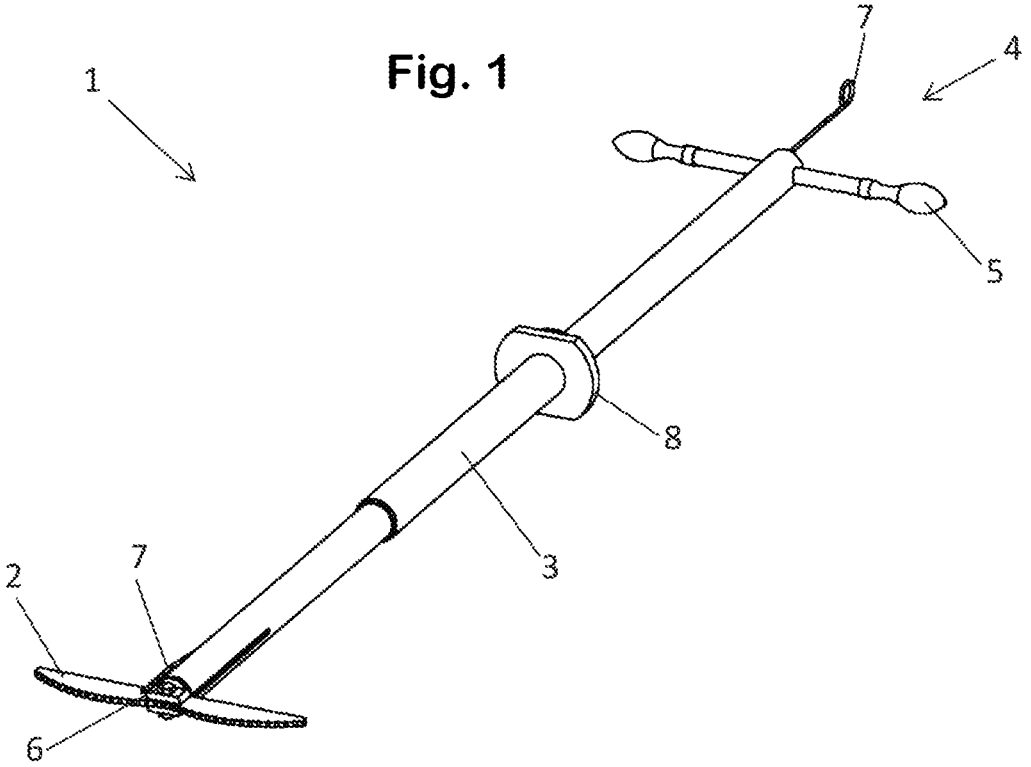
FIG. 1 shows an isometric view of a scraping tool according an embodiment of the invention

FIG. 1 shows an isometric view of a scraping tool 1 according to an embodiment of the invention. The scraping tool 1 comprises a longitudinal carrier 3, which can be provided (as shown in this figure) with a telescopic portion for varying the length of the longitudinal carrier 3. Further the longitudinal carrier 3 comprises a stop 8, which will be described in more detail in FIG. 3. A scraper unit 2 is swivel mounted on the longitudinal carrier 3 with the help of a bolt 6. A swivel motion of the scraper unit 3 can be induced by the wire 7. The wire 7 is fixed to the scraper unit 2. A rotational or longitudinal motion of the scraper unit 2 can be achieved by moving the handle 5, which takes the function of the activation device 4, in an appropriate way.

Figure 2:
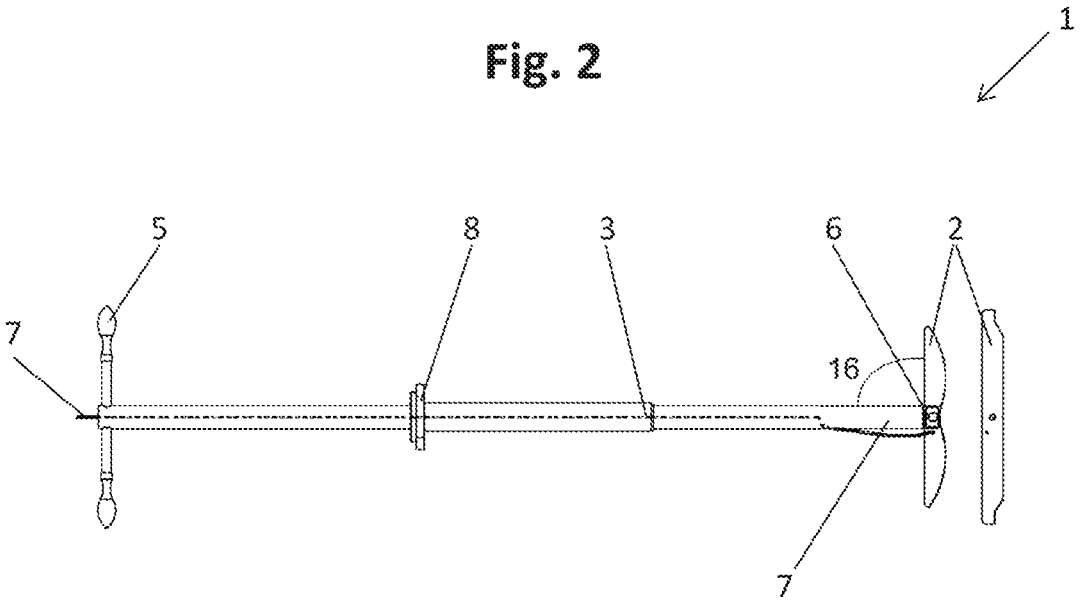
FIG. 2 shows a side view of the embodiment of FIG. 1

In FIG. 2 a side view of FIG. 1 can be seen. In this view it can be seen that the wire 7 is mounted eccentrically on the scraping unit 2. The wire 7 is leading through the longitudinal carrier 3 to an activation device 4. By a longitudinal motion of the wire 7 the swivel mounted scraper unit 2 can be rotated around the bolt 6. In this way the scraper unit 3 can be swiveled from a first position (for introducing the scraper unit 2 into a cavity) to a second position (for cleaning at least one surface of the cavity), wherein in the first position scraper unit 2 is disposed parallel to the longitudinal carrier 3 and wherein in the second position the scraping unit 2 is disposed substantially transversely to the longitudinal carrier 3, at an angle of 90°.

Further in FIG. 2 a second exemplary scraper unit 2 can be seen beside the swivel mounted scraper unit 2. This shows an additional embodiment of the scraper unit 2, which can be replaced by releasing the bolt 6. The additional scraper unit 2 has a different scraping surface to correspond to a surface which has to be cleaned.

Figure 3:
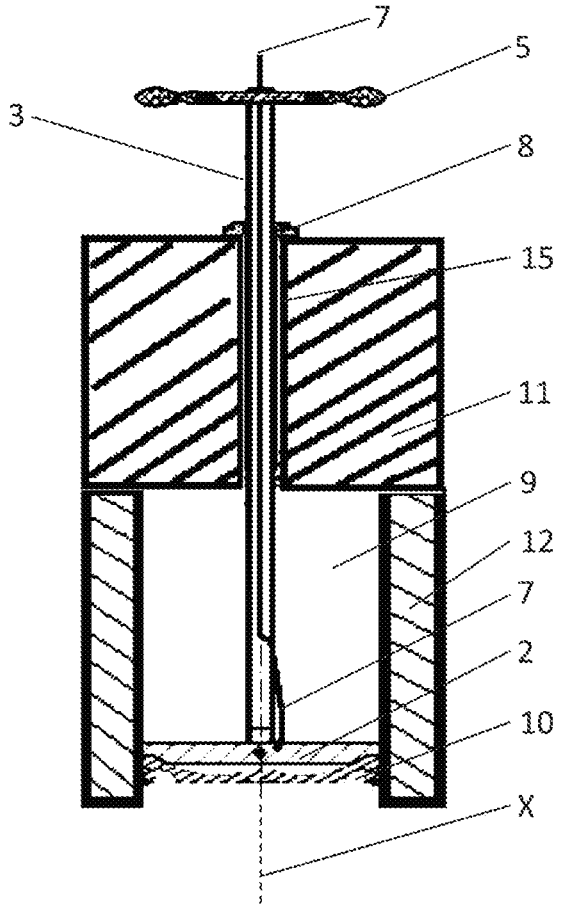
FIG. 3 shows a scraping tool inside a combustion chamber in cross section

FIG. 3 shows a scraping tool 1 inside a combustion chamber 9 in cross section. The scraping tool 1 extends through the cylinder head 11 (through the bore 15) into the combustion chamber 9 along a longitudinal direction X. The purpose of this through bore 15 in the cylinder head 11 is to carry the pre-chamber and a spark plug, which has been removed for the cleaning process (in other engines a through bore 15 for a spark plug or the like can be used).

The scraping tool 1 can be placed into the combustion chamber 9 though the bore 15 by swiveling the scraper unit 2 into a second position as described above with the help of the wire 7. After introducing the scraper unit 2 into the combustion chamber 9 the scraper unit 2 can be swiveled back to a first position by the help of the wire 7. The combustion chamber 9 is formed in this embodiment by the cylinder liner 12, the upper surface of the piston 10 and the inner surface of the cylinder head 11. For cleaning the upper surface of the piston 10 the scraping tool 1 is moved down till the scraper unit 2 contacts with his scraping surface the upper surface of the piston 10. To start the cleaning process the scraping tool is rotated by the handle 5. The rotational motion could also be created by connecting the activation device 4 to a rotary drive, e.g. a drilling machine.

The stop 8 is used to ensure that only deposits are removed from the upper surfaces of the piston 10 and that the upper surfaces of the piston 10 is not affected by the scraper unit 2.

Figure 4:
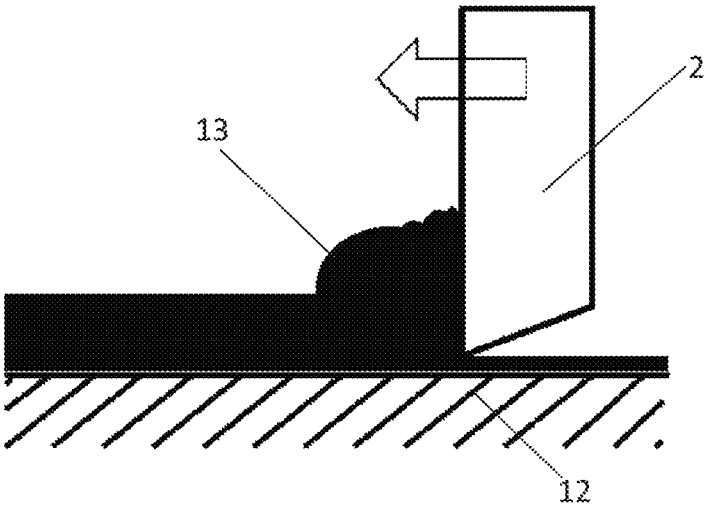
FIG. 4 shows the principal cleaning process

FIG. 4 shows the principal cleaning process. The scraping unit 2 is moved over the surface, which has to be cleaned. This surface, which has to be cleaned, is a contaminated surface 14. On this contaminated surface 14 deposits are removed by the motion of the scraping unit 2 over the contaminated surface 14. The deposits can be formed by combustion products 13.

What is claimed is:

1. A scraping tool for cleaning a combustion chamber of an internal combustion engine, comprising:

at least one scraper;

a longitudinal carrier;

an actuator; and a passage inside the at least one scraping tool to remove a combustion residue from the combustion chamber;

wherein the at least one scraper is configured to clean at least one surface of the combustion chamber; wherein the longitudinal carrier connects the at least one scraper with the actuator; wherein the at least one scraper is adjustable between a first configuration for introducing the at least one scraper through a bore in a cylinder head into the combustion chamber and a second configuration for cleaning the at least one surface of the combustion chamber.

2. The scraping tool according to claim 1, wherein the actuator comprises a handle, wherein a motion of the at least one scraper can be driven by hand.

3. The scraping tool according to claim 1, wherein the actuator comprises a connection interface for a rotary drive, wherein a motion of the at least one scraper can be driven by the rotary drive.

4. The scraping tool according to claim 1, wherein the scraping tool is configured for a rotational motion and/or longitudinal motion for scraping.

5. The scraping tool according to claim 1, wherein the at least one scraper has a scraping surface.

6. The scraping tool according to claim 1, wherein the at least one scraper has a grinding surface.

7. The scraping tool according to claim 1, wherein the at least one scraper comprises a wire brush.

8. The scraping tool according to claim 1, wherein the at least one scraper is replaceable.

9. The scraping tool according to claim 1, further comprising a wire connected to the at least one scraper leading through or on the longitudinal carrier to the actuator, wherein the wire is configured to move the at least one scraper between the first configuration and the second configuration.

10. The scraping tool according to claim 9, wherein a pivot joint is disposed in an intermediate position between opposite ends of a unitary body of the at least one scraper.

11. The scraping tool according to claim 1, further comprising a conduit connected to the passage, which can be used to remove the combustion residue from the combustion chamber, with a suction apparatus.

12. The scraping tool according to claim 1, further comprising a stop fixed on the longitudinal carrier to determine a position of the at least one scraper inside the combustion chamber.

13. A method for cleaning a combustion chamber of an internal combustion engine comprising:

introducing at least one scraper of a scraping tool through a bore in a cylinder head into the combustion chamber, wherein the scraping tool comprises a longitudinal carrier coupled to the at least one scraper, a stop fixed on the longitudinal carrier to determine a position of the at least one scraper inside the combustion chamber, and an actuator coupled to the longitudinal carrier, wherein the at least one scraper is adjustable between first and second configurations relative to the longitudinal carrier, and the at least one scraper fits through the bore in the first configuration;

adjusting the at least one scraper from the first configuration to the second configuration inside the combustion chamber; and cleaning at least one surface of the combustion chamber by moving the at least one scraper in the second configuration against the at least one surface.

14. The method according to claim 13, wherein the at least one surface comprises an interior head surface of the cylinder head inside the combustion chamber, and/or an interior wall surface of the combustion chamber, and/or an upper surface of a piston of the internal combustion engine.

15. The method according to claim 13, further comprising after cleaning, moving a piston away from the cylinder head; and removing a combustion residue produced by the cleaning.

16. The scraping tool according to claim 1, wherein the at least one surface comprises an interior head surface of the cylinder head inside the combustion chamber, and/or an interior wall surface of the combustion chamber, and/or an upper surface of a piston of the internal combustion engine.

17. The scraping tool according to claim 1, wherein the at least one scraper is disposed substantially parallel to the longitudinal carrier in the first configuration, and the at least one scraper is disposed at an angle between 10° and 170° with respect to the longitudinal carrier in the second configuration.

18. A scraping tool for cleaning a combustion chamber of an internal combustion engine, comprising:

at least one scraper configured to couple to a longitudinal carrier having an actuator;

wherein the at least one scraper is adjustable between a first configuration and a second configuration via a single wire coupled to the at least one scraper and driven by the actuator, the at least one scraper comprises a pivot joint at an intermediate position between opposite ends of the at least one scraper, the at least one scraper is configured to pass through a bore in a cylinder head into the combustion chamber in the first configuration, and the at least one scraper is configured to clean at least one surface of the combustion chamber in the second configuration.

19. The scraping tool according to claim 18, wherein the at least one scraper comprises a unitary body configured to rotate about the pivot joint between the first and second configurations, and the intermediate position is a center position between the opposite ends.

20. The scraping tool according to claim 18, comprising the longitudinal carrier having the actuator, wherein the at least one scraper is removably coupled to the longitudinal carrier.

21. The scraping tool according to claim 18, comprising a passage inside the scraping tool to remove a combustion residue from the combustion chamber.

22. The scraping tool according to claim 18, comprising a stop to determine a position of the at least one scraper inside the combustion chamber.

* * * * *